US011512922B2

(12) United States Patent
Schaffer

(10) Patent No.: US 11,512,922 B2
(45) Date of Patent: Nov. 29, 2022

(54) ADJUSTABLE ARROW LIFT AND SLIDE REST

(76) Inventor: John Paul Schaffer, Prior Lake, MN (US)

( * ) Notice: Subject to any disclaimer, the term of this patent is extended or adjusted under 35 U.S.C. 154(b) by 1003 days.

(21) Appl. No.: 12/684,968

(22) Filed: Jan. 10, 2010

(65) Prior Publication Data

US 2011/0168147 A1 Jul. 14, 2011

(51) Int. Cl.
*F41B 5/14* (2006.01)

(52) U.S. Cl.
CPC ..... *F41B 5/143* (2013.01)

(58) Field of Classification Search
CPC ..... F41B 5/143; F41B 5/14; F41B 5/1484
USPC ..... 124/44.5
See application file for complete search history.

(56) References Cited

U.S. PATENT DOCUMENTS 4,344,409 A 8/1982 Barner
4,715,355 A 12/1987 Lattig
4,865,007 A 9/1989 Saunders
4,865,008 A 9/1989 Troncoso
4,949,699 A * 8/1990 Gerber ..... F41B 5/143 124/24.1
5,117,803 A 6/1992 Johnson
5,161,514 A 11/1992 Cary
5,245,980 A 9/1993 Colvin
5,394,858 A 3/1995 Karolian
5,415,154 A 5/1995 Angeloni
6,044,832 A 4/2000 Piersons
6,178,959 B1 1/2001 Troncoso
6,679,241 B2 * 1/2004 Proctor ..... F41B 5/143 124/44.5
6,681,753 B2 * 1/2004 Afshari ..... F41B 5/143 124/44.5
6,688,296 B1 * 2/2004 Greywall ..... F41B 5/143 124/44.5
6,792,932 B2 9/2004 Musacchia, Jr.
6,823,856 B2 11/2004 Rager
6,948,488 B2 9/2005 Afshari
7,311,099 B2 12/2007 Rager
7,331,338 B2 2/2008 Mizek
7,409,950 B2 8/2008 Ellig et al.
7,597,075 B2 10/2009 Grace et al.
2008/0168971 A1 7/2008 Mizek et al.
(Continued)

*Primary Examiner* — Melba Bumgarner
*Assistant Examiner* — Amir A Klayman
(74) *Attorney, Agent, or Firm* — Dietz Law Office LLC

(57) ABSTRACT

An apparatus is described that is operable between a raised and lowered position for lifting an object without pivot or rotational joints. The apparatus may include an arrow rest for use with an archery bow, wherein the arrow rest has arrow support members operable to form a v-shaped arrow supporting notch, wherein the support members slide in a non-pivotal, non-rotational manner to vary a depth of the v-shaped notch. The support members are oriented to slide between a raised and lowered position. The arrow rest is suitable for coupling to the bow in a manner so that as the bow string is drawn the support members raise the arrow into a shooting position, and when the bow string is released the support members slide away from the arrow to avoid contact between the arrow and support members. Further, the arrow rest is adjustable to accommodate various diameter arrow shafts and to adjust the lateral and vertical orientation of the arrow shaft relative to the riser.

11 Claims, 11 Drawing Sheets

(56) References Cited

U.S. PATENT DOCUMENTS

| | | | | |
|---|---|---|---|---|
| 2008/0173290 | A1 | 7/2008 | Harwath et al. | |
| 2008/0216807 | A1* | 9/2008 | Troncoso | F41B 5/143 124/88 |
| 2011/0067682 | A1* | 3/2011 | Blosser et al. | 124/87 |
| 2011/0139137 | A1* | 6/2011 | Simo | F41B 5/0026 124/44.5 |
| 2012/0285432 | A1* | 11/2012 | Adams | F41B 5/143 124/44.5 |

* cited by examiner

ADJUSTABLE ARROW LIFT AND SLIDE REST

CROSS-REFERENCE TO RELATED APPLICATIONS

Not Applicable

FEDERAL SPONSORSHIP

Not Applicable

JOINT RESEARCH AGREEMENT

Not Applicable

TECHNICAL FIELD

This invention pertains generally to vertical lift mechanisms. More particularly, this invention is directed to an arrow rest for use with an archery bow, wherein the arrow rest raises an arrow in a non-pivotal, non-rotational manner.

BACKGROUND

Generally, improvements in archery equipment are intended to aid an archer's pursuit of a more accurate shot. Various accessories for the bow are available to, for example, increase bow stability, adjust arrow alignment and trajectory, and provide aiming aids for the archer. One such accessory, the arrow rest, typically suspends the arrow shaft above the bow riser shelf to eliminate arrow shaft and fletching contact with the riser. As the arrow propels from the bow the shaft of the arrow may flex depending upon the arrow spine and the amount of stored energy of the bow as the arrow is shot from the bow. Once the arrow disengages from the bow string the arrow begins to flex. This flexing of the arrow shaft may cause increased contact with the arrow rest. It has been observed that flight and trajectory of an arrow are affected if any portion of the arrow shaft or fletching contacts the arrow rest or riser of the bow.

Some prior arrow rests attempt to minimize contact with the arrow shaft and fletching as the arrow disengages from the bow string by affectively suspending an arrow in mid air above the riser of a bow, when the arrow disengages from the string. Although it is desirable to eliminate contact with the rest when the arrow is propelled, prior to release, it is desirable that the arrow rest contain the arrow on the rest prior to launching the arrow. It is further desirable that the arrow rest support the arrow shaft in a repeatable, fixed alignment relative to the riser to allow for finite adjustment of an arrow shafts longitudinal and horizontal orientation over the riser.

One common arrow rest that attempts to eliminate contact with the arrow during launching is referred to as a drop away or fall away rest. This type of rest typically provides one or more support arms that contact the underside of the arrow shaft. As the bow string is drawn to a shooting position, the support arms lift or rotate upward, lifting the arrow vertically from a resting position on the support arms. As the arrow is drawn to a shooting position, the arrow shaft has the ability to fall off the support arms of many prior drop away rests. Although various configurations of the support arms have been devised to reduce the likelihood that the arrow becomes misaligned when the arrow is lifted vertically, it may be difficult to keep the arrow balanced and aligned on these support arms when the bow is tilted from side to side or even upside down. Also, if the archer rests the bow on its side, for example, the arrow may slip off the support arms of these fall away rests. Attempts have been made to contain the arrow on the support arm, however these prior rests include an additional containment arm that adds to the complexity of the rest and increases the possibility of contact with the arrow during launch.

Further, as an arrow disengages from the bow string, the support arm(s) of the drop or fall away rest typically either rotate down and away from contact with the arrow shaft or drop down vertically. As the support arm(s) move downward, the bow limbs return forcefully to a non-flexed state, thereby creating potential overall forward inertia and vertical vibration in the bow. This inertia and vertical vibration effectively reduces the clearance distance between the support arms of the drop away rest and the arrow shaft. Additionally, the support arms themselves may tend to bounce upwards, back into contact with the arrow shaft, and further reducing the arrow shaft clearance.

SUMMARY

Embodiments according to aspects of the invention include an arrow rest that aligns and supports an arrow shaft in the lowered position, while the arrow is raised, and in the raised position. The arrow rest includes at least two support members that actuate laterally relative to the arrow shaft. The support members each engage an underside of the arrow shaft prior to launching the arrow. The support members keep the arrow aligned on the rest even if the bow is tilted from side to side. When the arrow is propelled from the bow, the supports are biased laterally away from the arrow shaft to avoid contact with the shaft or fletching. Lateral rather than vertical actuation of the support members reduces the relative influence that resonating vibrations of the bow may have on the support members.

The arrow rest includes an actuator assembly engaged to at least one of the support members to effectuate lateral sliding of the support members between a raised and lowered position. The support members may be coupled or linked together so that actuation of one support member affectively actuates the other support member. The rest may also include a biasing system that biases the support members toward either the raised or lowered position.

Also described herein are various coupling arrangements of the arrow rest to the bow, to thereby synchronize the lateral movement of the support members with either the drawing or release of the bow string. In one particular coupling arrangement, when the bow string is drawn, the support members slide laterally to reduce the inner distance between tips of the support members. An arrow resting on the support members is affectively raised to a ready or shooting position as the bow string is drawn. The alignment and configuration of the support members inhibit the arrow from falling off the support members as the arrow is raised. Upon release of the bowstring, the support members are biased laterally away from the arrow, and the arrow propels past the support members without contacting the support members.

In one particular embodiment, the invention is directed to an arrow rest comprising a first arrow support member, a second arrow support member, a base, and an actuator assembly engaged to the first support member. The actuator assembly operates to slide the first support member laterally between a raising and lowering position. A linkage between the first and second support members couple together the support members so that when an actuation force is applied to the first support member a similar actuation force is applied to the second support member but in an opposite direction. A bias system biases the first and second support members laterally toward the lowering position. Additionally, a support lock retains the first and second arrow support members in a fixed position.

In another particular embodiment, the invention is directed to an arrow rest comprising spaced apart first and second supports, wherein each support engage an underside of an arrow shaft prior to launching the arrow. The first and second supports may form a notch in which the arrow shaft contacts the notch at two separate points. When an arrow is positioned within the arrow rest, the arrow shaft is elevated from a lowered position to a raised position when a distance separating a free end of each support is reduced. The rest includes a bias system that biases the first and second supports to the lowered position. The rest may also include a support lock that retains the first and second supports in a fixed, raised and loaded position.

In another particular embodiment of the invention the support members are aligned relative to each other to form an arrow supporting notch. The support members are actuated and biased to slide the support members in a non-pivotal, non-rotational manner, thereby varying a depth of the notch. When the depth of the notch is varied, the arrow shaft resting in the bottom of the notch is raised or lowered. The support members align and contain an arrow shaft when the support members slide between a raised and lowered position. These and other particular embodiments of the invention are described in detail in the following detailed description.

The accompanying drawings, which are incorporated in and constitute a portion of this specification, illustrate embodiments of the invention and, together with the detailed description, serve to further explain the invention. The embodiments illustrated herein are presently preferred; however, it should be understood, that the invention is not limited to the precise arrangements and instrumentalities shown. For a fuller understanding of the nature and advantages of the invention, reference should be made to the detailed description in conjunction with the accompanying drawings.

DESCRIPTION OF THE DRAWINGS

In the various figures, which are not necessarily drawn to scale, like numerals throughout the figures identify substantially similar components.

DETAILED DESCRIPTION

Figure 1:
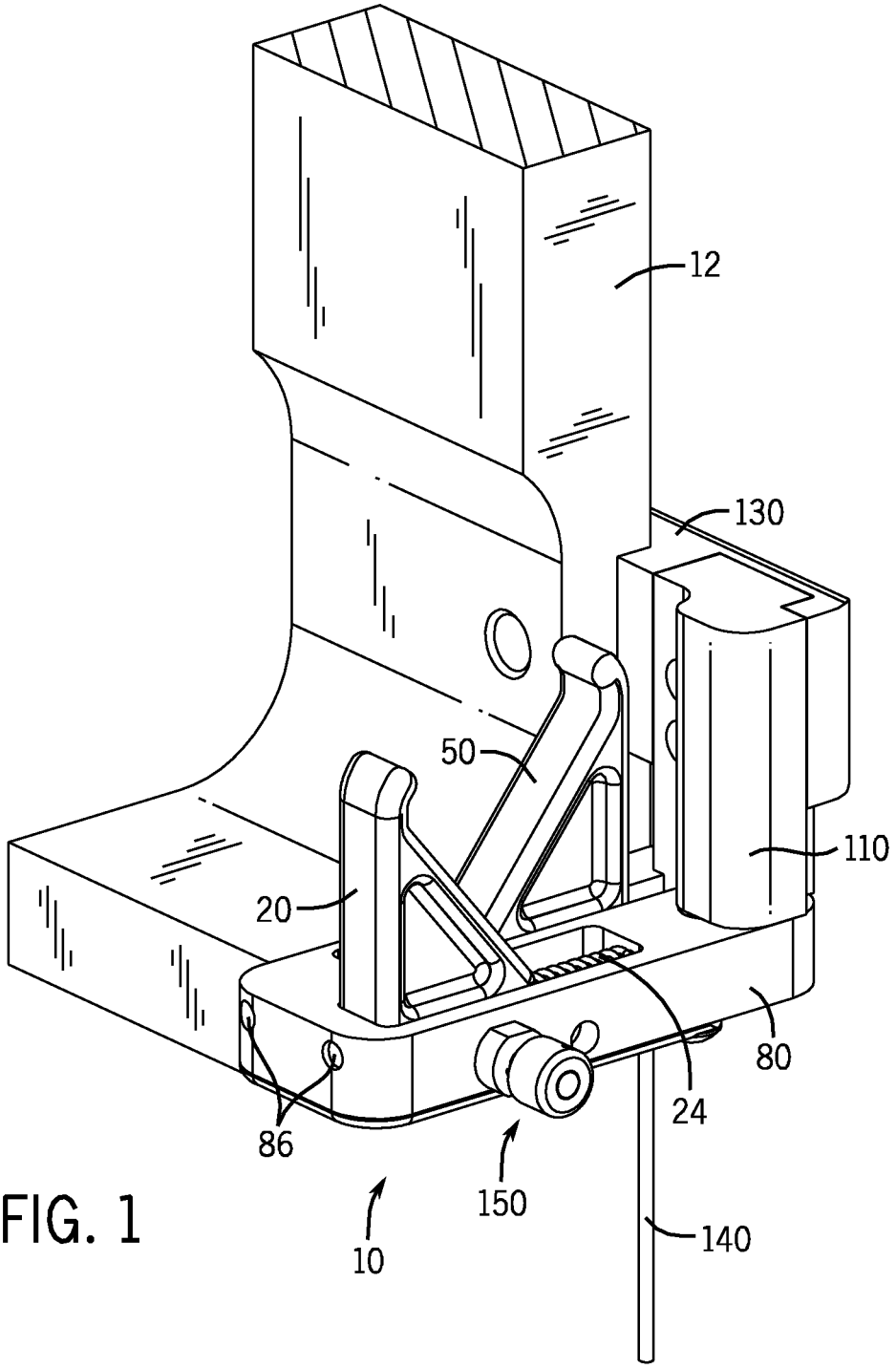
FIG. 1 is a partial sectional rear perspective view of the arrow lift and rest system mounted to a bow riser in accordance with an embodiment of the invention.

The following description provides detail of various embodiments of the invention, one or more examples of which are set forth below. Each of these embodiments are provided by way of explanation of the invention, and not intended to be a limitation of the invention. Further, those skilled in the art will appreciate that various modifications and variations may be made in the present invention without departing from the scope or spirit of the invention. By way of example, those skilled in the art will recognize that features illustrated or described as part of one embodiment, may be used in another embodiment to yield a still further embodiment. Thus, it is intended that the present invention also cover such modifications and variations that come within the scope of the appended claims and their equivalents.

A user of the arrow rest 10 may use the arrow rest for recreational shooting, hunting, or competitive shooting alike. In many situations an archer may desire an arrow rest that allows the user to hold the bow in an orientation other than vertical, while at full draw, during the draw or at rest, without concern that the arrow will fall or roll off the arrow support. The arrow rest 10 of the present invention includes support members 20 and 50 that actuate laterally and contain the arrow 14 within the support members at full draw, during draw or at rest. Further, when the support members 20 and 50 are locked in place with support lock 150, the bow may be held in any orientation, including upside down, and the arrow 14 will be contained between the support members.

Further, an archer may seek to eliminate as much as possible vibrations that resonate vertically through the bow. Thus, an archer may desire support members 20 and 50 that quickly disengage laterally from the arrow shaft 14 rather than downwardly in a rotational or straight vertical drop. Those skilled in the art will appreciate that by varying the contour and steepness of the support angle 42 and 72 of corresponding support members 20 and 50, a quicker lateral disengagement of the arrow shaft will occur as compared to rotational or straight vertical drop.

Figure 2:
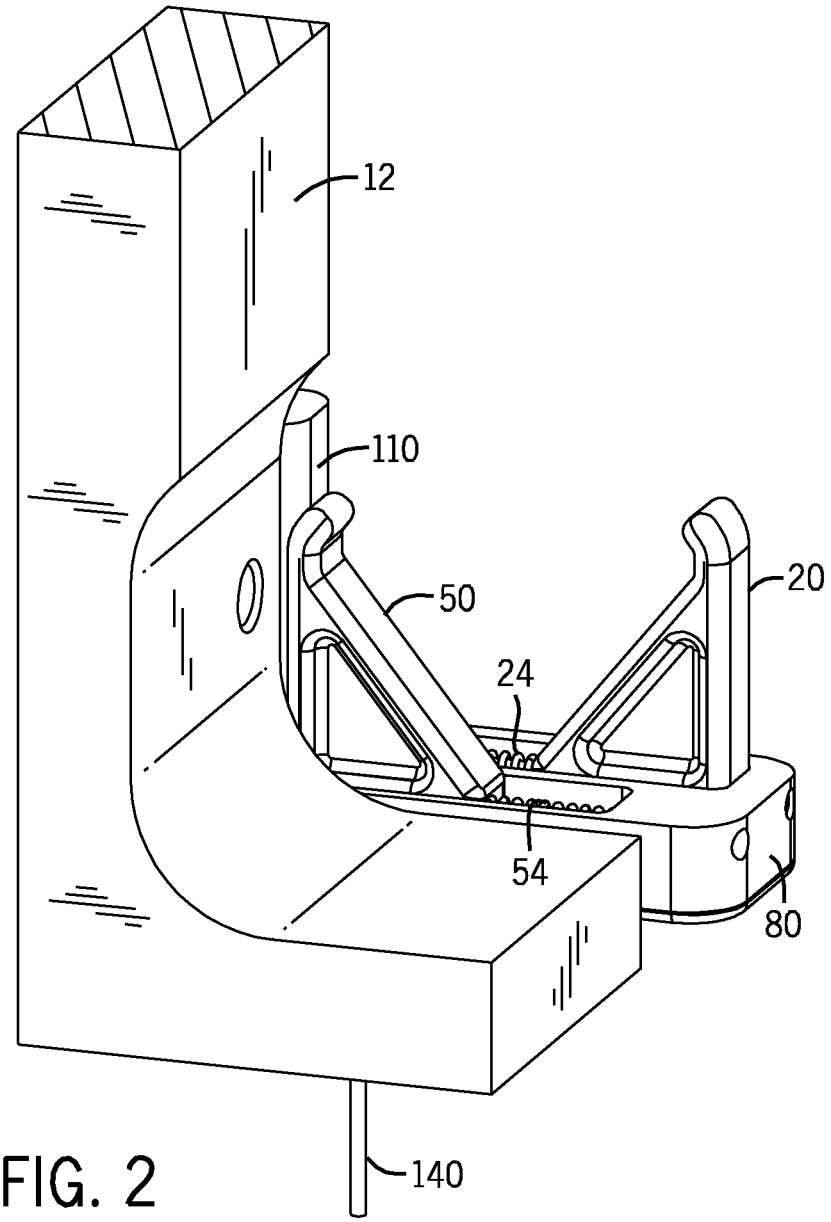
FIG. 2 is a partial sectional front perspective view of the arrow rest system of the type shown in FIG. 1.
Figure 3:
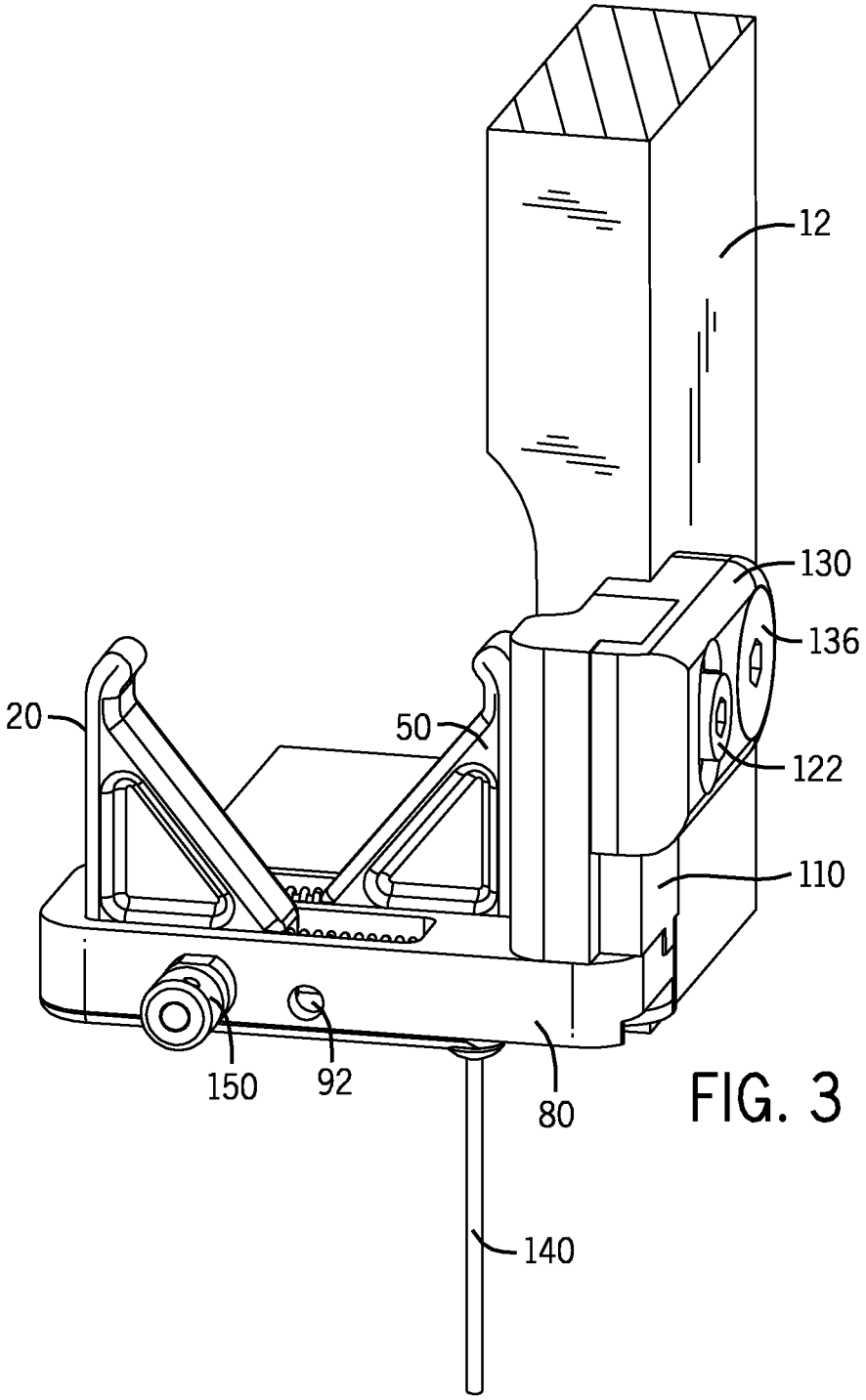
FIG. 3 is a partial sectional alternate rear perspective view of the arrow rest system of the type shown in FIG. 1.

Turning attention now to the Figures, embodiments of the lifting mechanism or arrow rest 10 of the present invention will now be described in more detail. With reference to FIGS. 1-3, arrow rest 10 is shown attached to a sectioned away portion of a riser 12 of a bow. The arrow rest 10 generally includes a first support 20, second support 50, base 80, vertical slide mount 110, riser mount bracket 130, actuation cord or linkage 140 and support lock 150. The arrow rest 10 is attached to the riser 12 with riser mount screw 136. A cord 140 is used to effectively actuate support members 20 and 50. The support members 20 and 50 are biased open, in the lowered position, with corresponding bias springs 24 and 54. The actuation and biasing of support members 20 and 50 is described in additional detail with reference to FIGS. 6-8.

Figure 4:
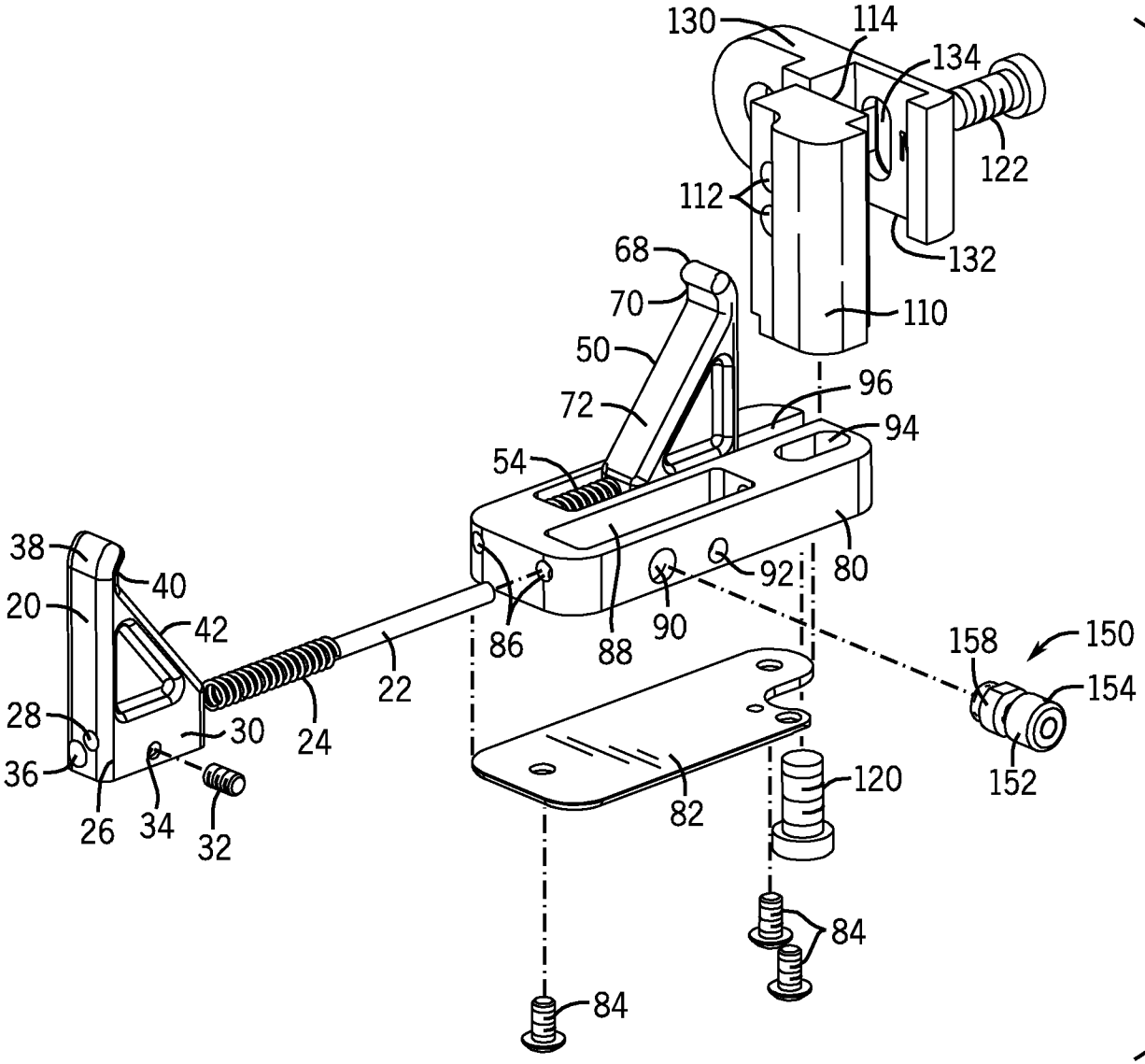
FIG. 4 is a partial exploded perspective view of the arrow rest system in accordance with an embodiment of the invention.
Figure 5:
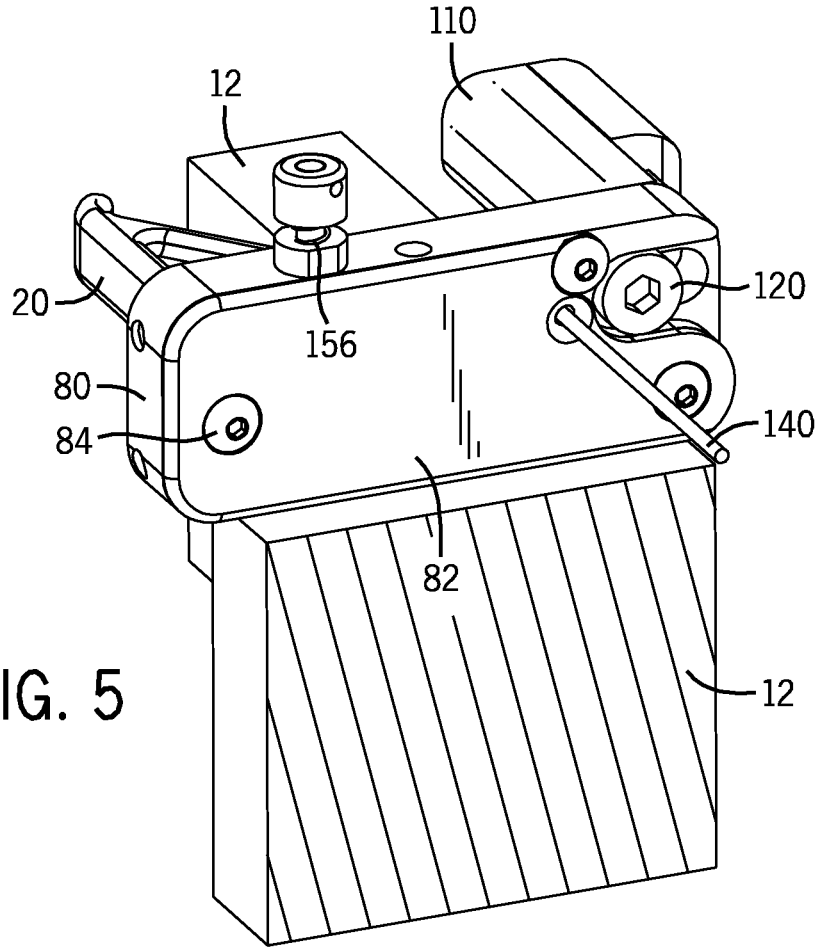
FIG. 5 is a partial sectional perspective view of the underside of the arrow rest system of the type shown in FIG. 1.

FIGS. 4 and 5 show greater detail of the components of the arrow rest 10. First support 20 includes a base 26, sides 30 of the base 26, and a tip or end 38. An aperture 28 extends through the base 26 and is adapted for receiving a first support guide pin 22. The guide pin 22 extends through aperture 28 and engages with the base 80. First support bias spring 24 surrounds a portion of guide pin 22 and is positioned between the base 26 of support member 20 and base 80. A channel 36 extends through the base 26 and is adapted for receiving the cord or linkage 140. A threaded aperture 34 extends through the base 26 and intersects channel 36. Timing set screw 32 screws into threaded aperture and engages cord 140 extending through channel 36.

Second support 50 is a similar construction and includes a base 56, sides 60 of the base 56, and a tip or end 68. An aperture 58 extends through the base 56 and is adapted for receiving a second support guide pin 52. The guide pin 52 extends through aperture 58 and engages with the base 80. Second support bias spring 54 surrounds a portion of guide pin 52 and is positioned between the base 56 of support member 50 and base 80. A channel 66 extends through the base 56 and is adapted for receiving the cord or linkage 140. The channel 66 at the outer end of support member 50 is counter bored so that an end of the cord may be knotted and the knot of the cord fits within the counter bore. An alternative embodiment not shown in the Figure, includes a threaded aperture 64 extending through the base 56 and intersecting channel 66. An optional fixed end set screw 62 screws into threaded aperture 64 and engages cord 140 extending through channel 66 to thereby fix in place the end of the cord and to allow for an alternative mode of adjusting the length of the cord between the first and second support members 20 and 50.

Figure 6:
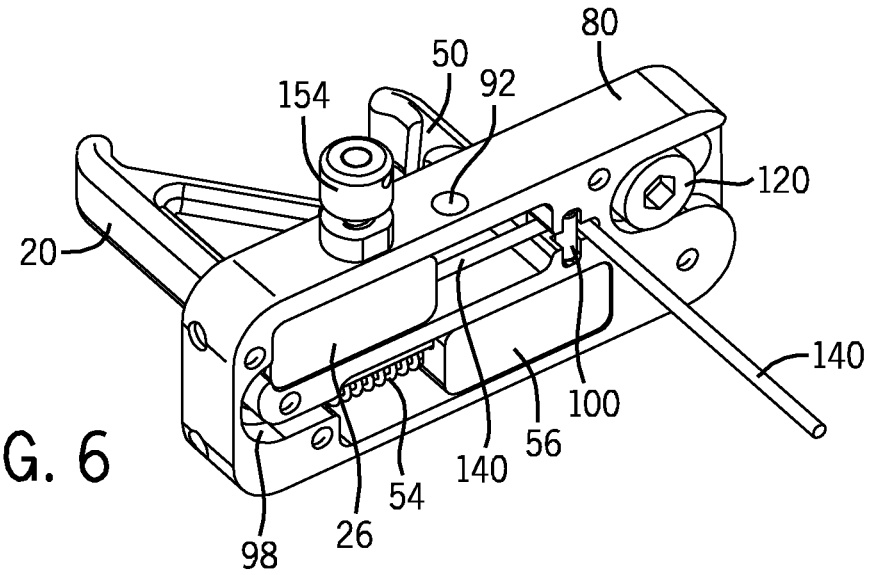
FIG. 6 is a perspective view of the underside of the arrow rest system of the type shown in FIG. 1 having the base cover plate removed.

Base or frame 80 includes a cover plate 82, cover plate screws 84, and roller or pin 100 (shown in FIG. 6). Apertures 86 for guide pins 22 and 52 extend longitudinally through the base 80. Guide pins 22 and 52 may be press fit into apertures 86 or may be fastened, glued, welded, or otherwise fixed within the aperture. Channels 88 extend through the base 80 from a top surface to the bottom surface of the base, forming a guide channel in which the base 26 and 56 of respective supports 20 and 50 may slide. Aperture 90 extends through a side of said base 80 into channel 88 and is adapted for receiving support lock 150. An access hole 92 extends through base 80 into channel 88. Support 20 may be actuated and slid within channel 88 so that the timing set screw 32 is accessible through hole 92. An elongate clearance aperture 94 extends through base 80 and is adapted for receiving base mount screw 120. An alignment channel 96 extends into the base 80 from the top surface and is adapted for receiving a flange extending from a bottom of the vertical slide mount 110. The flange slides in alignment channel 96 and allows for controlled horizontal adjustment of the base relative to the vertical slide mount 110.

Vertical slide mount 110 includes vertical mount rail 114 and apertures 112 extending through a side of vertical slide mount 110. Rail 114 is adapted to engage and slide within riser mount channel 132 formed within riser mount bracket 130. Elongated vertical mount aperture 134 extends riser mount 130 and aligns with threaded vertical mount apertures 112. Vertical slide mount 110 is fastened to base 80 with base mount screw 120 and fastened to riser mount bracket 130 with vertical mount screw 122. Riser mount bracket 130 is engaged and fixed to riser 12 with riser mount screw 136.

Figure 7:
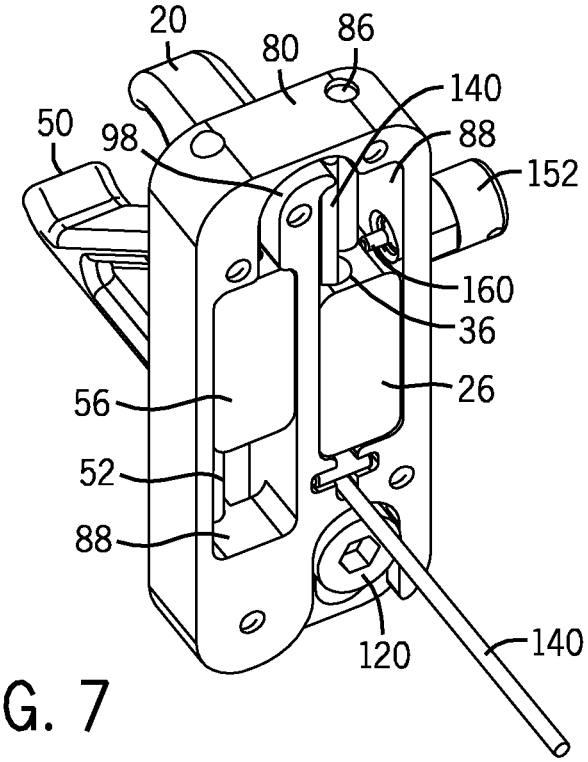
FIG. 7 is an end perspective view of an underside of the arrow rest system of the type shown in FIG. 1 having the base cover plate removed and the support lock engaged to the support.

Support lock 150 includes knob 152, knob set screw 154, knob bias spring 156, lock base 158 and lock pin 160 (see FIG. 7). Lock base 158 engages and is fixed within aperture 90 of base 80. Knob 152 and lock pin 160 are biased by spring 156 between a locked position (shown in FIG. 7) and disengaged position (shown in, for example, FIG. 5).

Figure 8:
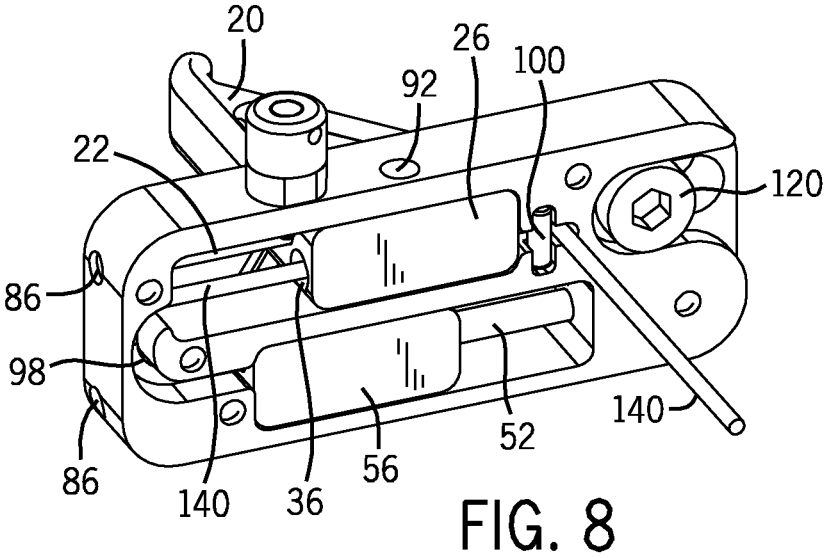
FIG. 8 is a rear bottom perspective view of an underside of the arrow rest system of the type shown in FIG. 1 having the base cover plate removed and the support members in the raised position.

Referring now to FIGS. 6-8 the path of cord 140 is shown extending around pin 100, through base 26 of support 20, through channels 88, serpentine channel 98, and into base 56 of support 50. One end of cord 140 is fixed to support member 140. The cord 140 is then routed through channel 66 of support base 56 and channel 88 corresponding with support 50 and then through serpentine channel 98. Routing of the cord continues through channel 36 of support base 26 and through channel 88 of support 20. The support 20 and 50 are squeezed together and the cord 140 held taught until timing set screw 32 is accessible through access hole 92. The set screw 32 is tightened against cord 140 to thereby link and control the length of the cord 140 between support members 20 and 50 and to define the timing of the actuation between the support members. The free end of cord 140 may be attached with serving string to the buss cable (power cable or the secondary payout side of the string depending upon the particular bow) that moves down as the bow is drawn. The attachment point is below the horizontal plain of the arrow rest. The amount of slack in the cord 140 when attached to the buss cable, or secondary payout string, will depend upon the amount of travel in the buss cable or secondary payout string from rest to full draw. The amount of travel depends upon the particular bow, cams and amount of travel of the buss cable or string. When the bow is drawn, the cable moves downward, applying a pulling force to cord 140, which results in a closing force applied to support members 20 and 50.

A bias spring 54 applies a biasing force to support 50 thereby biasing support 50 through channel 88 in a sliding fashion towards an open or lowered position. Since the length of cord 140 between support 20 and support 50 is fixed, a biasing force applied to support 50 also applies a biasing force to support 20 causing the support 20 to bias in a sliding fashion through channel 88 toward an open or lowered position. Alternatively, a second bias spring 24 may be utilized to apply a biasing force to support 20 to bias support 20 toward an open or lowered position.

In an alternate embodiment, bias springs 24 and alternate bias spring 54 may be positioned on opposite ends of corresponding supports 20 and 50 to thereby bias the supports towards each other and in a closed or raised position. When the bias springs are positioned on opposite sides of the support members, the orientation of the support members on the guide pins is flipped. Thus the angled ramp 42 of support member 20 would face away from the riser and angled ramp 72 of support member 50 would face towards riser (the embodiments shown in the Figures show angled ramp 42 of support member 20 facing towards the riser and angled ramp 72 of support member 50 faces away from the riser). In this alternate embodiment, the closed or raised position is the at rest position. In this arrangement, free end of cord 140 is attached with server string to the buss cable (for example without limitation intended) that moves up as the bow is drawn. The cord 140 is attached without slack to the buss cable below the horizontal plane of the rest. When the bow is drawn, the cable moves up resulting in slack in the cord 140. When the bow string is released from full draw, the cord tightens and a reverse flex of the limbs causes the buss cable to extend downward beyond the relaxed position of the cable. When the cable extends past the relaxed position, a force is applied to the cord that causes the support members to actuate open as the fletching passes through the support members. In this manner, applying a pulling force to cord 140, results in an opening force applied to support members 20 and 50. Although the preferred actuation assembly and bias system have been described, those skilled in the art will appreciate that other actuators and biasing mechanisms of know suitable construction may be substituted without departing from the scope of the invention. For example, without limitation the linkage of the actuator assembly may be replaced with a sheave or worm drive.

Figure 9:
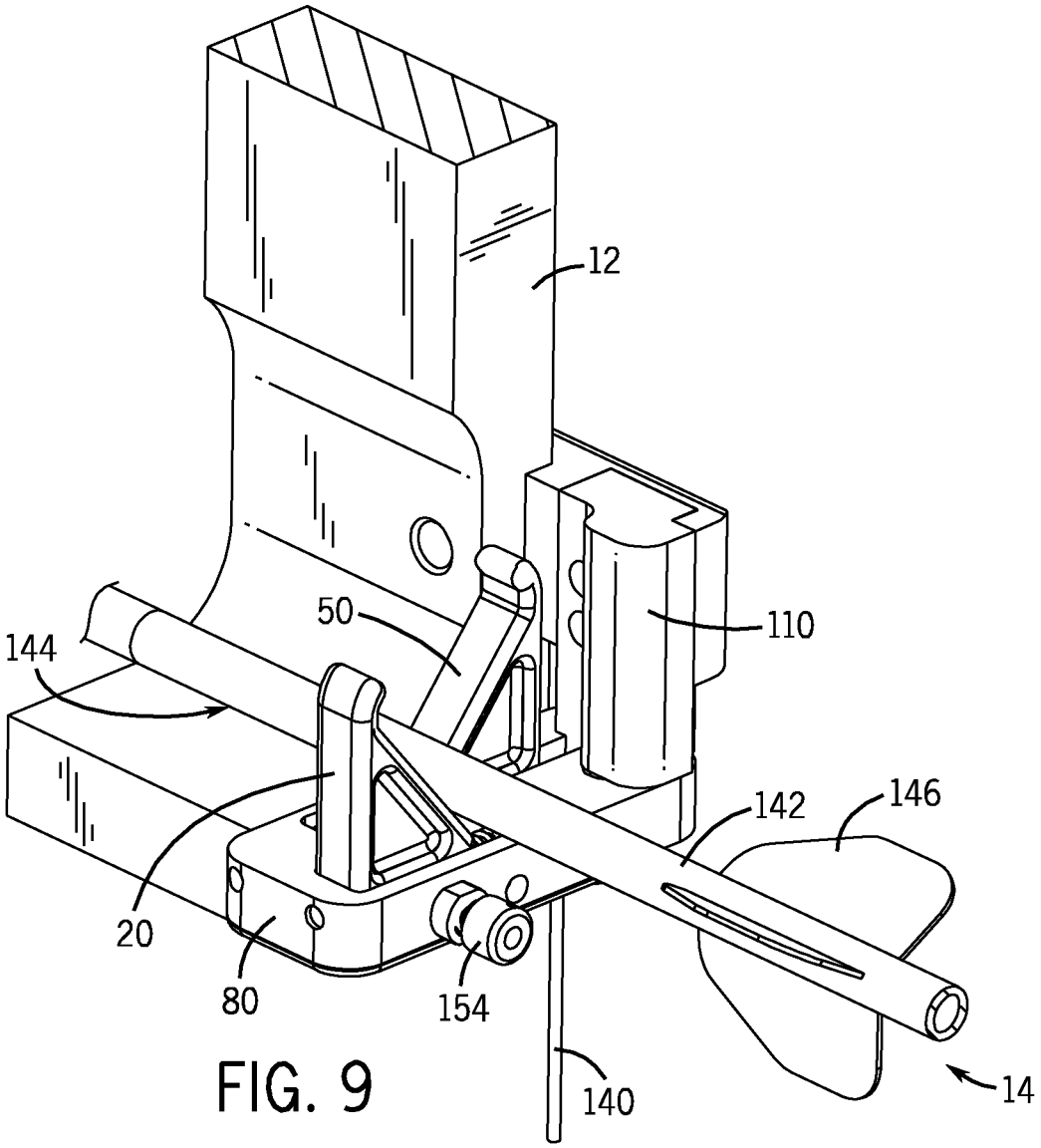
FIG. 9 is a partial sectional rear perspective view of the arrow rest system mounted to a bow riser in accordance with an embodiment of the invention and showing a portion of an arrow shaft in a lowered position.
Figure 10:
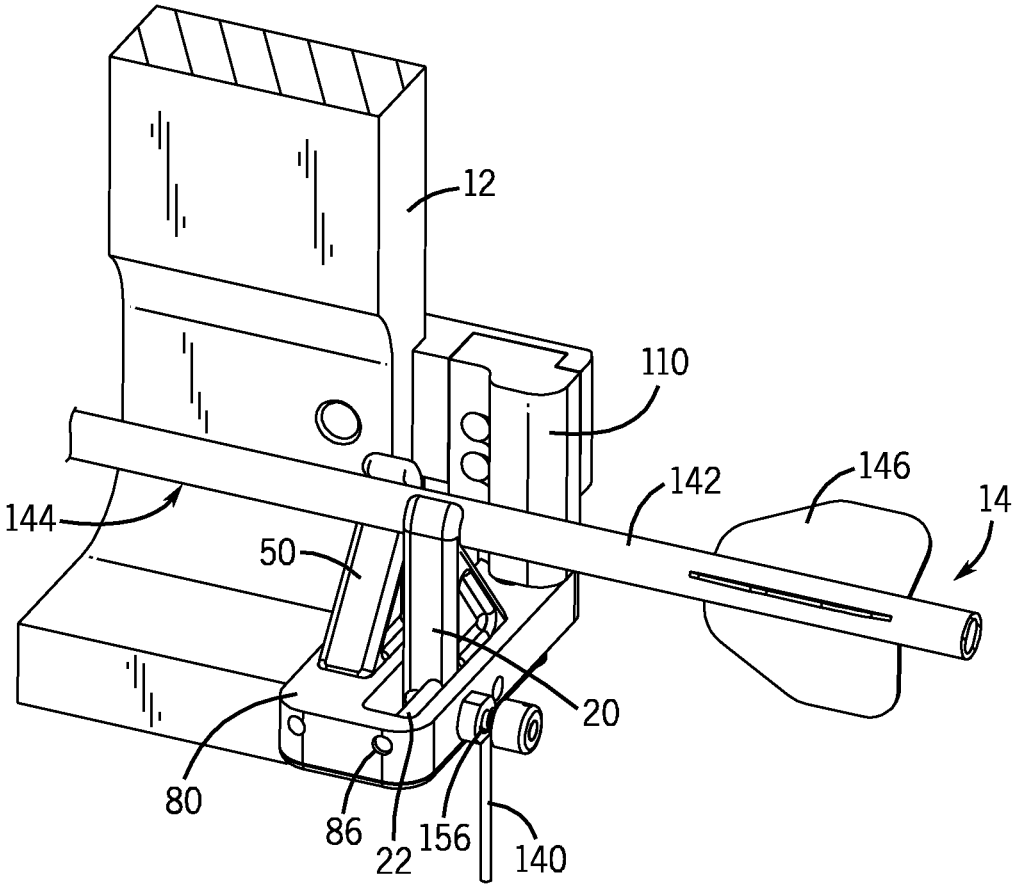
FIG. 10 is a partial sectional rear perspective view of the arrow rest system mounted to a bow riser in accordance with an embodiment of the invention and showing a portion of an arrow shaft in a raised position.
Figure 11:
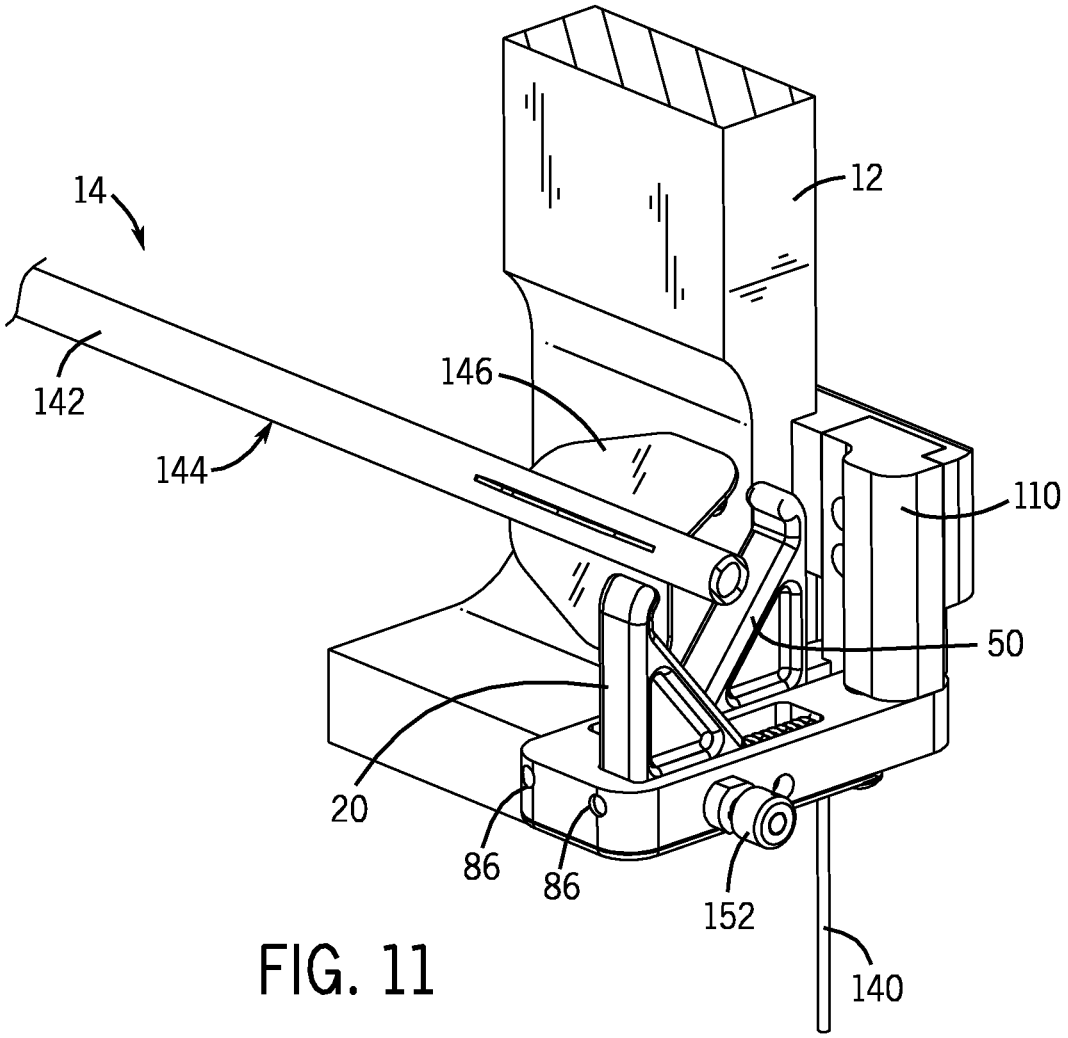
FIG. 11 is a partial sectional rear perspective view of the arrow rest system mounted to a bow riser in accordance with an embodiment of the invention and showing fletching of an arrow clearing the support members during launch.

Having described the constructional features of embodiments of the invention, attention is now directed to FIGS. 9-11. As shown in FIG. 11, a user may selectively place an arrow 14 between support members 20 and 50. FIG. 10 illustrates the position of support members 20 and 50 in the locked, closed or raised position. As the bow is released from full draw the support members bias towards an open or lowered position and the fletching or vane 146 of the arrow passes through the rest without contacting the support members 20 and 50.

Figure 12:
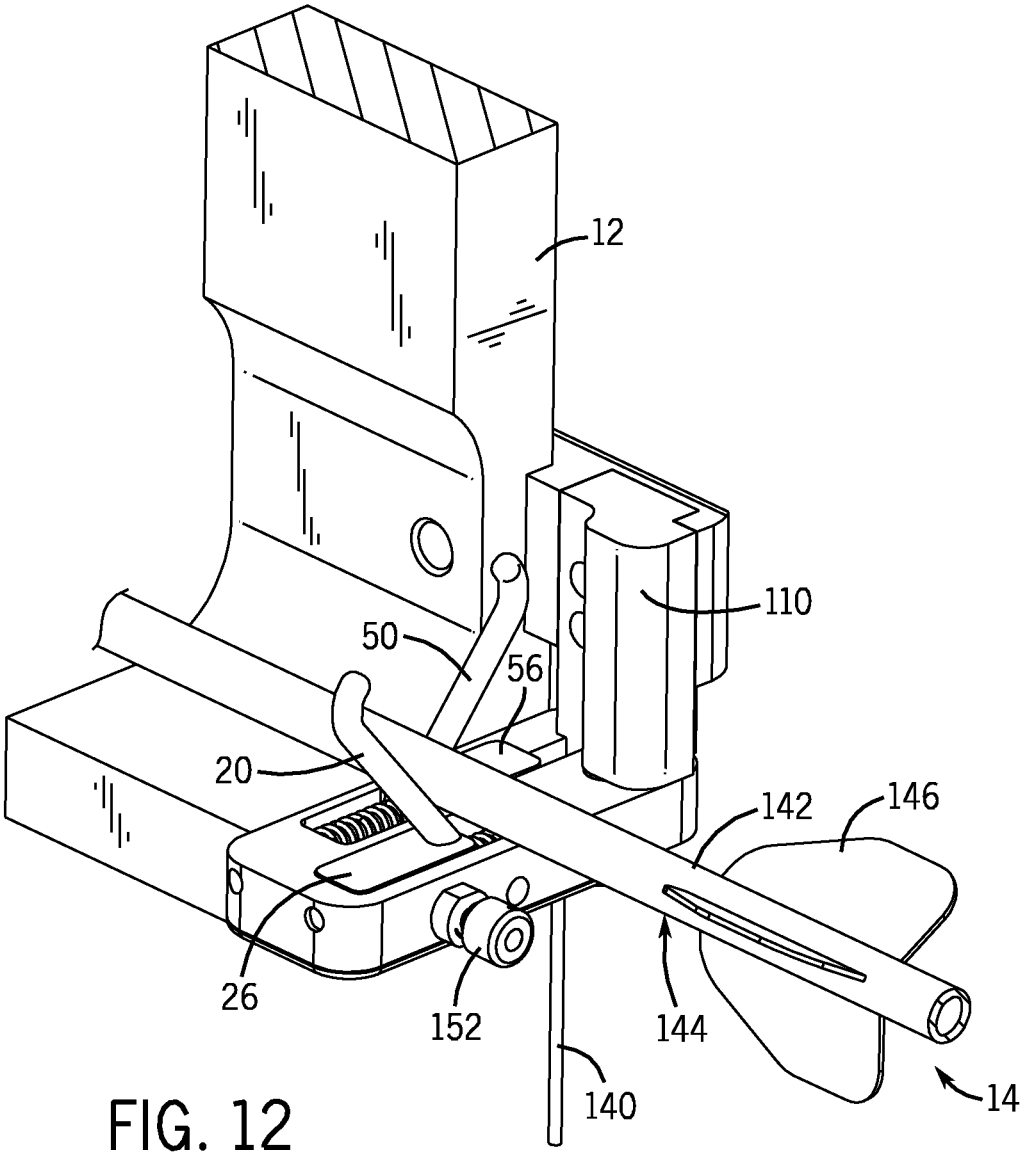
FIG. 12 is a partial sectional rear perspective view of the arrow lift and rest system mounted to a bow riser in accordance with an embodiment of the invention showing a portion of an arrow shaft in a lowered position.
Figure 13:
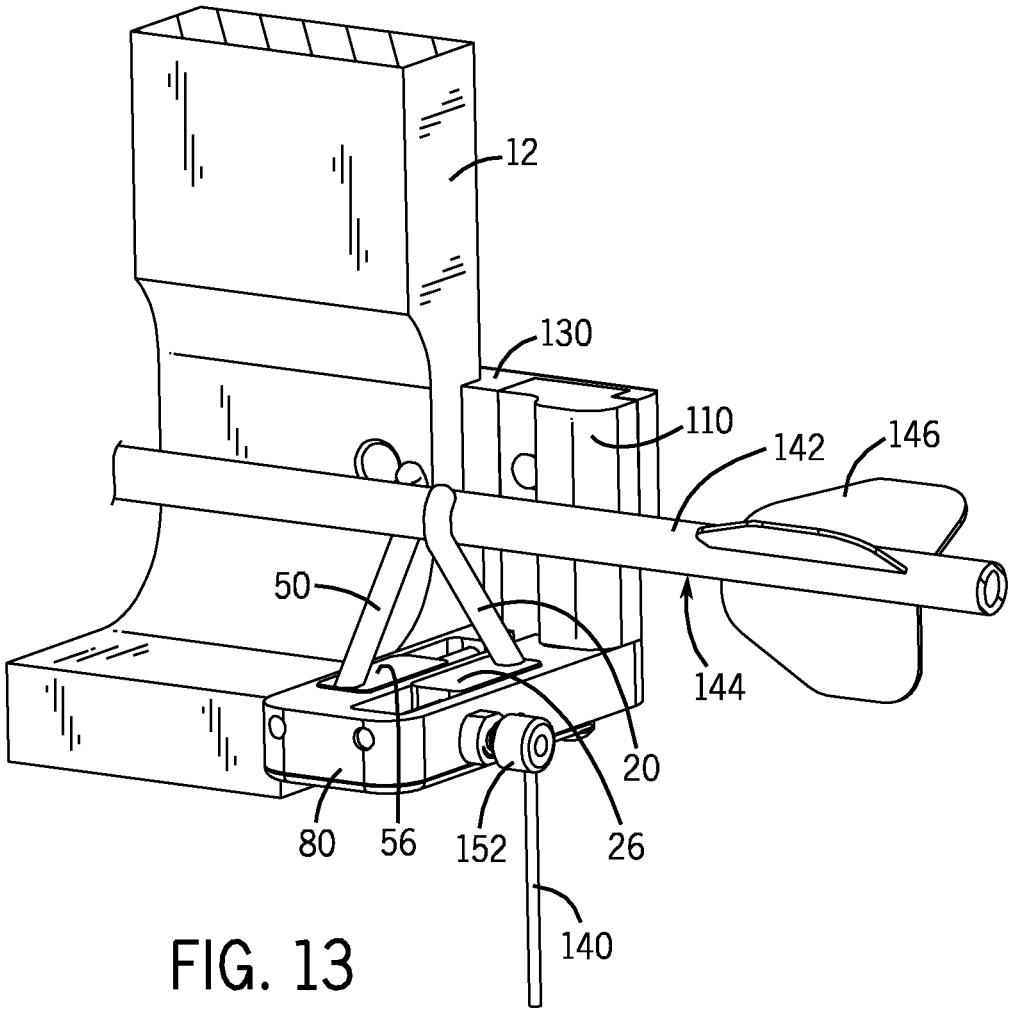
FIG. 13 is a partial sectional rear perspective view of the arrow lift and rest system mounted to a bow riser in accordance with an embodiment of the invention and showing a portion of an arrow shaft in a raised position.

FIGS. 12-13 demonstrates the raising and lowering position of arrow 14 with alternate constructed supports 20 and 50. The alternate support 20 and 30 are tubular and may be made from known suitable construction. The support members may be covered with a moleskin or other composition to reduce the amount of sound created as the arrow slides over the ramp surfaces 42 and 72 as the bow is drawn. FIG. 13 illustrates the position of alternate support members 20 and 50 in the locked, closed or raised position.

These and various other aspects and features of the invention are described with the intent to be illustrative, and not restrictive. This invention has been described herein with detail in order to comply with the patent statutes and to provide those skilled in the art with information needed to apply the novel principles and to construct and use such specialized components as are required. It is to be understood, however, that the invention can be carried out by specifically different constructions, and that various modifications, both as to the construction and operating procedures, can be accomplished without departing from the scope of the invention. Further, in the appended claims, the transitional terms comprising and including are used in the open ended sense in that elements in addition to those enumerated may also be present. Other examples will be apparent to those of skill in the art upon reviewing this document.

What is claimed is:

1. A lift system for lifting an object without utilizing a pivot, said system comprising:

a first support member;

a second support member;

a frame having the first support member slidingly engaged to said frame and having the second support member slidingly engaged to said frame; and means for actuating the first and second support members wherein the means for actuating causes both the first and second support members to slide linearly relative to the frame between a first object raising position and second object lowering position, wherein actuation of the first support member is linear.

2. The lift system according to claim 1, wherein said first and second support members are adapted to receive an arrow shaft.

3. The lift system according to claim 1, further including a bias system that biases the first and second support members towards at least one of the object lowering position and object raising position.

4. The lift system according to claim 1, further including a support lock that retains the first and second support members in a fixed position.

5. An arrow rest comprising:

first and second spaced apart arrow supports, wherein at least one of said first and second spaced apart supports includes a sloped surface that slopes upward and tangentially away from an arrow flight path of said rest, and means for actuating said first and second supports linearly under the arrow flight path to at least one of reduce and increase a separation distance between at least one of said first and second supports and the arrow flight path of said rest, wherein the sloped surface has a distance sufficient such that when the means for actuating actuates the first and second supports to reduce the separation distance between the first and second supports, an arrow slides up the sloped surface the arrow is raised a sufficient amount that fletching of an arrow avoids contact with the rest when the arrow is launched from the rest.

6. The arrow rest according to claim 5, wherein said first and second supports are aligned in an orientation to form an arrow supporting notch, and further wherein said first and second arrow supports slide in a non-pivotal, non-rotational manner to vary a depth of the notch.

7. The arrow rest according to claim 5, further including a bias system that biases at least one of said first and second arrow supports towards a lowered position.

8. The arrow rest according to claim 5, further including a bias system that biases at least one of said first and second arrow supports towards a raised position.

9. The arrow rest according to claim 5, wherein the first and second arrow supports may raise an arrow shaft when the first and second arrow supports actuate from a lowered position to a raised position.

10. The arrow rest according to claim 5, further including a support lock that retains the first and second arrow supports in a fixed position.

11. The arrow rest according to claim 5, wherein a free end of at least one of said first and second spaced apart supports further includes a tip having a tip portion that arcs back towards the arrow flight path.

* * * * *